US008286606B2

(12) United States Patent
Breidenbach et al.

(10) Patent No.: US 8,286,606 B2
(45) Date of Patent: Oct. 16, 2012

(54) PISTON FOR AN INTERNAL COMBUSTION ENGINE

(75) Inventors: Paul Breidenbach, Bechenheim (DE); Carsten Tauscher, Trebur (DE)

(73) Assignee: GM Global Technology Operations LLC, Detroit, MI (US)

( * ) Notice: Subject to any disclaimer, the term of this patent is extended or adjusted under 35 U.S.C. 154(b) by 697 days.

(21) Appl. No.: 12/065,238

(22) PCT Filed: Aug. 26, 2006

(86) PCT No.: PCT/EP2006/008381

§ 371 (c)(1),
(2), (4) Date: Feb. 28, 2008

(87) PCT Pub. No.: WO2007/031188

PCT Pub. Date: Mar. 22, 2007

(65) Prior Publication Data

US 2008/0216790 A1 Sep. 11, 2008

(30) Foreign Application Priority Data

Sep. 14, 2005 (DE) ..... 10 2005 043 747

(51) Int. Cl.
*F02F 3/00* (2006.01)

(52) U.S. Cl. ..... 123/193.6

(58) Field of Classification Search ..... 92/238–230, 92/228, 208; 123/193.6
See application file for complete search history.

(56) References Cited

U.S. PATENT DOCUMENTS

| | | | | |
|---|---|---|---|---|
| 1,294,833 | A | 2/1919 | Ricardo | |
| 2,066,613 | A | 3/1926 | Day | |
| 2,006,008 | A * | 6/1935 | Nelson | 92/230 |
| 2,149,862 | A * | 3/1939 | Nelson | 92/228 |
| 3,987,709 | A | 10/1976 | Day | |
| 5,299,490 | A * | 4/1994 | Harrer et al. | 92/208 |
| 5,562,074 | A | 10/1996 | Koch | |
| 6,205,836 | B1 | 3/2001 | Yamagata et al. | |
| 6,240,828 | B1 | 6/2001 | Fujimoto | |
| 6,357,341 | B1 * | 3/2002 | Watanabe et al. | 92/238 |
| 6,539,836 | B2 | 4/2003 | Ishida et al. | |
| 6,860,190 | B2 * | 3/2005 | Oversby et al. | 92/208 |
| 2002/0007730 | A1 | 1/2002 | Ishida et al. | |
| 2005/0188840 | A1 | 9/2005 | Yasuyama | |

FOREIGN PATENT DOCUMENTS

| | | | |
|---|---|---|---|
| DE | 1525581 | A1 | 1/1970 |
| DE | 2407788 | A1 | 9/1974 |
| DE | 4109160 | A1 | 9/1992 |
| DE | 4434994 | A1 | 4/1996 |
| DE | 19918328 | A1 | 10/1999 |
| DE | 19908670 | A1 | 11/2000 |
| DE | 69917981 | T2 | 10/2004 |
| DE | 69922882 | T2 | 5/2005 |
| DE | 60301636 | T2 | 6/2006 |
| EP | 0385390 | | 9/1990 |
| EP | 0897058 | A2 | 2/1999 |
| EP | 1348859 | A2 | 10/2003 |

(Continued)

*Primary Examiner* — M. McMahon
(74) *Attorney, Agent, or Firm* — Ingrassia Fisher & Lorenz, P.C.

(57) ABSTRACT

A piston for an internal combustion engine is provided that comprises a piston head, onto which a piston hub and a piston skirt are formed, as well as reinforcing ribs, which extend between piston hub and piston skirt and which each comprise two portions that are curved in opposite directions.

11 Claims, 1 Drawing Sheet

FOREIGN PATENT DOCUMENTS

| | | | |
|---|---|---|---|
| EP | 1561938 | A1 | 8/2005 |
| GB | 129585 | A | 7/1919 |
| GB | 130411 | | 8/1919 |
| GB | 578531 | A | 7/1946 |
| GB | 2347194 | A | 8/2000 |
| JP | 9329057 | A | 12/1997 |
| JP | 2003083159 | A | 3/2003 |
| JP | 2004353546 | A | 12/2004 |
| WO | 0231336 | A1 | 4/2002 |
| WO | 2006058596 | A1 | 6/2006 |

* cited by examiner

PISTON FOR AN INTERNAL COMBUSTION ENGINE

CROSS-REFERENCE TO RELATED APPLICATIONS

This application is a U.S. National-Stage entry under 35 U.S.C. §371 based on International Application No. PCT/EP2006/008381, filed Aug. 26, 2006, which was published under PCT Article 21(2) and which claims priority to German Application No. DE 10 2005 043 747.8, filed Sep. 14, 2005.

TECHNICAL FIELD

The present invention relates to a piston for an internal combustion engine, in particular for a motor vehicle engine, comprising a piston head, onto which a piston hub and a piston skirt are formed, and comprising reinforcing ribs extending between piston hub and piston skirt.

BACKGROUND

Such pistons for the engines of passenger cars are nowadays generally made of aluminium. They have a typical compression height, i.e. the distance between the upper edge of the piston head and a centre line of the piston hub, of typically 23 to 35 mm. With these dimensions, given an optimized design, generally the load limits of the material are reached. In order to construct an internal combustion engine of the same external dimensions with a larger cylinder capacity and more power or in order to make such an engine of the same cylinder capacity more compact and hence lighter and more economical, it is desirable to be able to reduce the compression height of the piston further.

At least one object of the present invention is to indicate a configuration for a piston that allows addresses the foregoing. In addition, other objects, features and characteristics will become apparent from the subsequent detailed description, summary, appended claims, taken in conjunction with the accompanying drawings and foregoing background.

SUMMARY

According to an embodiment of the invention, a piston of the initially indicated type and the reinforcing ribs each comprise two portions that are curved in opposite directions. These reinforcing ribs are necessary in order to allow the pressure load acting upon the thin piston head to be transmitted without excessive deformation to a connecting rod acting on the piston. In contrast to conventional reinforcing ribs that are curved uniformly over their entire length, these ribs of alternate curvature may yield in radial direction in relation to the cylinder longitudinal axis to a pressure acting between piston skirt and cylinder jacket without, in so doing, strongly influencing the deformation of the piston skirt, thereby allowing the piston skirt to adapt over a large area to the deformed cylinder wall.

When the piston skirt forms two axially projecting plate members on either side of the hub, preferably in each case a pair of the reinforcing ribs extend between the hub and each plate member.

In order to enable a large-area adaptation of these plate members to the cylinder wall, preferably each plate member extends in peripheral direction of the piston beyond the connecting regions between it and the pair of reinforcing ribs acting thereon.

To enable a space-saving positioning of the reinforcing ribs, of the two curved portions of each rib of a pair the portion adjacent to the piston hub has a centre of curvature at a side facing the respective other rib of the pair, and the portion of the same rib adjacent to the piston skirt has a centre of curvature at a side remote from the respective other rib of the pair.

In order to save weight, the hub may be split in two in the direction of the axis of its piston boss, and in order nevertheless to guarantee an adequate dimensional stability of the piston head, the two parts of the hub may be connected by an annular rib that is formed onto the piston head.

For further reinforcement, two further pairs of reinforcing ribs may extend in each case from the hub, substantially parallel to the direction of the axis of the piston boss thereof, in the direction of the piston skirt.

The piston is manufactured from an iron material, for example from cast iron or steel. As such an iron material has a greater strength and a higher modulus of elasticity than aluminium, the wall thickness of the piston and the width of the piston skirt on the far side of the plate members may be kept smaller than in an aluminium piston of identical stability under load. It is therefore possible to realize particularly low compression heights of the piston.

The use of an iron material also makes it possible to fix a piston pin in an eye of the hub by simple pressing, so that the conventional practice, for aluminium pistons, of securing the piston pin by producing undercuts in the piston boss and inserting retaining rings into the undercuts becomes superfluous.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

Figure 1:
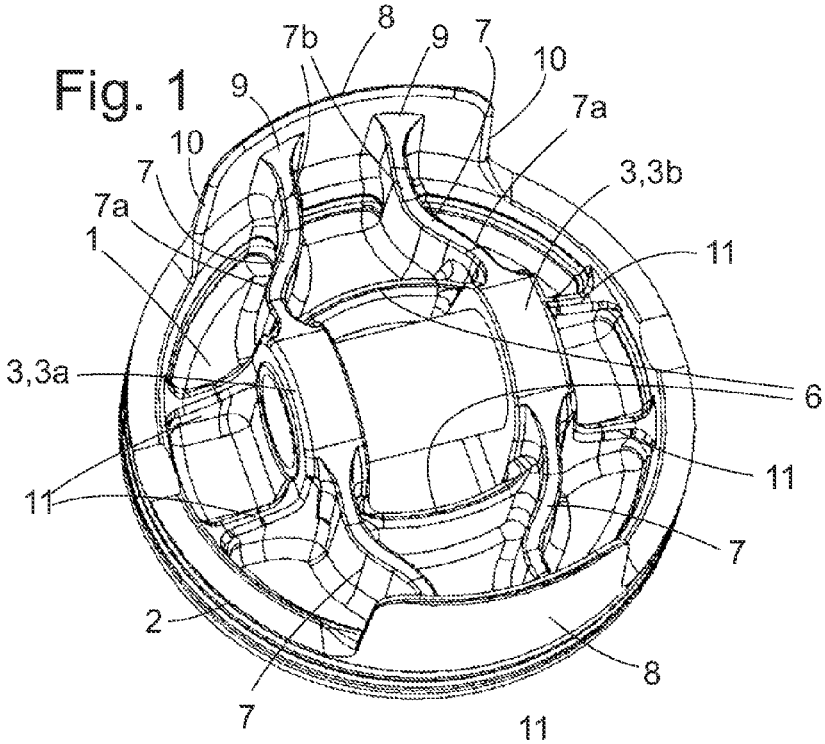
FIG. 1 is a perspective view of a piston according to the invention made of iron material.
Figure 2:
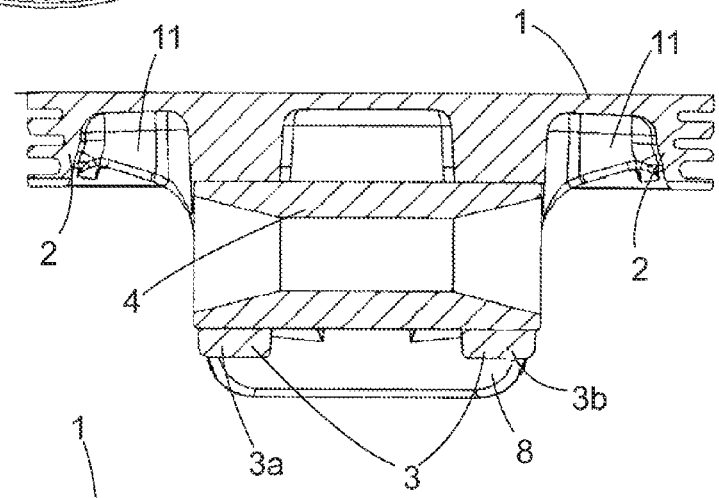
FIG. 2 is a section through the piston of FIG. 1.
Figure 3:
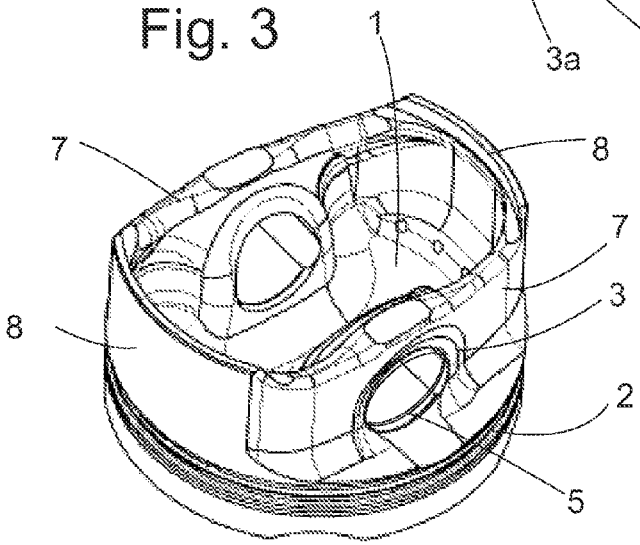
FIG. 3 is a perspective view of a conventional aluminium piston for a passenger car engine.

Like the conventional piston of FIG. 3, the piston according to the invention shown in FIGS. 1 and 2 has a head plate member 1, which faces the combustion chamber of a cylinder and from which a cylindrical piston skirt 2 projects. Grooves formed on the outer periphery of the piston skirt 2 receive non-illustrated piston rings. Formed in the centre of the underside of the head plate member 1 is a piston hub 3, in which a piston pin 4 is press-fitted. To save weight, the piston hub 3 is subdivided into portions 3*a*, 3*b*, which each border one end of the piston pin 4 and between which the piston pin 4 extends freely. The use of iron as a material for the piston allows the piston pin 4 to be mounted by pressing in a permanently fixed manner in the piston hub 3, in contrast to the aluminium piston of FIG. 3, in which there are formed in the bore of the piston hub 3 two undercut grooves 5, in which are mounted retaining rings that prevent the gudgeon pin (not shown in FIG. 3) from slipping by resting against the end faces thereof. As the retaining rings are not required for the piston of FIG. 1, the piston hub 3 does not have to project beyond the ends of the piston pin 4; for this reason, a non-illustrated connecting rod fork that acts on the piston pin 4 may be kept narrow and consequently lightweight.

The central region of the head plate member 1 is reinforced by means of an annular rib 6 of low height that extends through the two parts 3*a*, 3*b* of the piston hub.

From each of the two parts 3*a*, 3*b* of the piston hub two curved reinforcing ribs 7 extend towards two plate members 8, which lengthen the piston skirt 2 in the longitudinal direction of the cylinder. The reinforcing ribs 7 each comprise two portions with opposite directions of curvature, an outwardly convex portion 7*a* adjacent to the piston hub 3 and an, at the outside, concave portion 7*b* adjacent to the plate member 8. The shape curved in two directions allows the reinforcing ribs 7 to yield elastically to a pressure acting between the plate members 8 and an opposite cylinder wall without, in so doing, exerting on the plate member 8 a significant torque that curves the plate member 8, thereby allowing the plate member 8 to adapt over a large area to the cylinder wall. Given a purely outwardly convex curvature of the reinforcing ribs 7, as shown in FIG. 3, an elastic upsetting deformation of the ribs leads to the action of a torque upon the plate members 8 that has the effect of reducing the curvature thereof and therefore makes it difficult to achieve a large-area contact of the plate members 8 with the cylinder wall.

A large-area contact of the plate members 8 with the cylinder wall is further promoted by the fact that the points of attachment 9 of the ribs 7 to each plate member 8 is shifted from the lateral edges 10 of the plate member 8 markedly towards the centre thereof, so that the edge regions of the plate member 8 outside of the points of attachment 9 may adapt relatively easily to the cylinder wall.

On either side of, and substantially parallel to the section plane of FIG. 2, reinforcing ribs 11 of low height extend between the piston hub 3 and the piston skirt 2.

With the previously described piston construction it is possible to realize a compression height of below 20 mm without exceeding the load limit of the piston material. Owing to the high load-bearing capacity of the iron material, the material thickness may be selected generally lower than for an aluminium piston, and as the piston pin may also be shortened compared to that of an aluminium piston, the weight of the piston according to the invention is in any case not substantially greater than that of an aluminium piston designed for a corresponding engine power. The poorer thermal conductivity of the iron material compared to aluminium and the low thickness of the head plate member 1 result in less heat being removed from the piston via the piston rings to a cooling water jacket surrounding the cylinder. The temperature of the head plate member 1 is therefore higher during operation than that of a comparable aluminium piston, this proving to be an advantage during part-load operation in terms of mixture formation, particularly in the case of a direct injection engine.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

The invention claimed is:

1. A Piston for an internal combustion engine comprising:
a piston head;
a piston hub formed onto the piston head;
a piston skirt formed onto the piston head; and
reinforcing ribs extending between the piston hub and the piston skirt,
wherein the reinforcing ribs each comprise two portions that are curved in opposite directions, and the piston skirt forms two axially projecting plate members on either side of the hub and in each case a pair of the reinforcing ribs extends between the hub and each plate member,
wherein each plate member extends in peripheral direction beyond connecting regions between the plate member and the pair of reinforcing ribs and wherein the hub is split into two parts in the direction of the axis of its piston boss and the two parts of the hub are connected by an annular rib that is formed onto the piston head.

2. The piston according to claim 1, wherein of the two curved portions of each rib of a pair, the portion adjacent to the piston hub has a centre of curvature at a side facing the respective other rib of the pair and the portion adjacent to the piston skirt has a centre of curvature at a side of said each rib remote from the respective other rib of the pair.

3. The piston according to claim 1, wherein a second pair of reinforcing ribs extend in each case from the hub, substantially parallel to the direction of the axis of the piston boss thereof, in the direction of the piston skirt.

4. The piston according to claim 1, wherein the piston is at least partially manufactured from an iron material.

5. The piston according to claim 4, wherein a piston pin is press-fitted in a boss of the hub.

6. The piston of claim 1, wherein the two portions that are curved in opposite directions each curve laterally away from a longitudinal axis of the reinforcing rib when viewed from above the reinforcing rib.

7. A Piston for an internal combustion engine comprising:
a piston head;
a piston hub formed onto the piston head;
a piston skirt formed onto the piston head; and
reinforcing ribs extending between the piston hub and the piston skirt,
wherein the reinforcing ribs each comprise two portions that are curved in opposite directions, and the piston skirt forms two axially projecting plate members on either side of the hub and in each case a pair of the reinforcing ribs extends between the hub and each plate member,
wherein each plate member extends in peripheral direction beyond connecting regions between the plate member and the pair of reinforcing ribs and wherein a second pair of reinforcing ribs extend in each case from the hub, substantially parallel to the direction of the axis of the piston boss thereof, in the direction of the piston skirt.

8. The piston according to claim 7, wherein of the two curved portions of each rib of a pair, the portion adjacent to the piston hub has a centre of curvature at a side facing the respective other rib of the pair and the portion adjacent to the piston skirt has a centre of curvature at a side of said each rib remote from the respective other rib of the pair.

9. The piston according to claim 7 wherein the hub is split into two parts in the direction of the axis of its piston boss and the two parts of the hub are connected by an annular rib that is formed onto the piston head.

10. The piston according to claim 7, wherein the piston is at least partially manufactured from an iron material.

11. The piston according to claim 10, wherein a piston pin is press-fitted in a boss of the hub.

* * * * *